US009309783B2

(12) United States Patent
Nallam et al.

(10) Patent No.: US 9,309,783 B2
(45) Date of Patent: Apr. 12, 2016

(54) SEAL ASSEMBLY FOR TURBINE SYSTEM

(71) Applicant: General Electric Company, Schenectady, NY (US)

(72) Inventors: Revanth Krishna Nallam, Karnataka (IN); Debabrata Mukhopadhyay, Karnataka (IN); Karthik Srinivasan, Karnataka (IN)

(73) Assignee: General Electric Company, Schenectady, NY (US)

( * ) Notice: Subject to any disclaimer, the term of this patent is extended or adjusted under 35 U.S.C. 154(b) by 695 days.

(21) Appl. No.: 13/738,339

(22) Filed: Jan. 10, 2013

(65) Prior Publication Data

US 2014/0193243 A1 Jul. 10, 2014

(51) Int. Cl.
*F01D 25/24* (2006.01)
*F01D 11/02* (2006.01)

(52) U.S. Cl.
CPC ..... *F01D 25/24* (2013.01); *F01D 11/02* (2013.01)

(58) Field of Classification Search
CPC ..... F01D 11/001; F01D 11/02; F01D 11/004; F01D 25/24
See application file for complete search history.

(56) References Cited

U.S. PATENT DOCUMENTS

| | | | | | |
|---|---|---|---|---|---|
| 3,940,153 | A * | 2/1976 | Stocker | F16J 15/4472 | 277/418 |
| 4,103,899 | A * | 8/1978 | Turner | F01D 11/001 | 277/303 |
| 4,351,532 | A * | 9/1982 | Laverty | F16J 15/4472 | 277/419 |
| 5,029,876 | A * | 7/1991 | Orlando | F16J 15/4472 | 277/419 |
| 6,926,495 | B2 * | 8/2005 | Diakunchak | F01D 11/02 | 415/12 |
| 7,445,213 | B1 * | 11/2008 | Pelfrey | F01D 11/02 | 277/418 |
| 7,465,152 | B2 | 12/2008 | Nigmatulin | | |
| 7,500,842 | B2 | 3/2009 | Kikusawa | | |
| 7,520,718 | B2 * | 4/2009 | Engle | F01D 5/3015 | 415/173.7 |
| 7,540,709 | B1 * | 6/2009 | Ebert | F04D 29/083 | 415/173.7 |
| 8,075,256 | B2 * | 12/2011 | Little | F01D 11/001 | 415/173.1 |
| 2013/0051992 | A1 * | 2/2013 | Diakunchak | F01D 11/001 | 415/173.7 |

* cited by examiner

*Primary Examiner* — Igor Kershteyn
(74) *Attorney, Agent, or Firm* — Ernest G. Cusick; Hoffman Warnick LLC

(57) ABSTRACT

The disclosure includes a sealing assembly for a turbine system. In one embodiment, the sealing assembly is for a turbine having a rotor blade and a stator nozzle. The sealing assembly includes a pair of oppositely facing seal teeth including concave surfaces. The pair of oppositely facing seal teeth are positioned on one of the rotor blade and the stator nozzle, and are for sealingly engaging the other of the rotor blade and the stator nozzle during operation of the turbine.

17 Claims, 7 Drawing Sheets

SEAL ASSEMBLY FOR TURBINE SYSTEM

BACKGROUND OF THE INVENTION

1. Technical Field

The disclosure is related generally to a turbine system. More particularly, the disclosure is related to a seal assembly for a turbine system.

2. Related Art

Conventional gas and steam turbine systems are utilized to generate power for electric generators. In general, conventional gas and steam turbine systems generate power by passing a fluid (e.g., steam, hot gas) through a compressor and a turbine component of the turbine system. More specifically, fluid may flow through a fluid flow path for rotating a plurality of rotating buckets of the turbine component for generating the power. The fluid may be directed through the turbine component via the plurality of rotating buckets and a plurality of stationary nozzles positioned between the rotating buckets.

The efficiency of the turbine component, and as a result the entire turbine system, is partially dependent on the ability of the turbine component to prevent fluid leakage within the turbine system. That is, the turbine component directs a fluid through a fluid flow path for driving the plurality of rotating buckets to generate power. The turbine component also provides a purge fluid (e.g., cooling air) to a wheel space of the turbine component to prevent damage to the components (e.g., rotating buckets, stator nozzles) of the turbine component during operation. Allowing purge fluid to enter the fluid flow path and/or allowing fluid flow to enter the wheel space of the turbine can significantly decrease the efficiency of the turbine component.

BRIEF DESCRIPTION OF THE INVENTION

A seal assembly for a turbine system is disclosed. In one embodiment, the seal assembly is for a turbine having a rotor blade and a stator nozzle. The seal assembly includes: a pair of oppositely facing seal teeth including concave surfaces, the pair of oppositely facing seal teeth positioned on one of the rotor blade and the stator nozzle for sealingly engaging the other of the rotor blade and the stator nozzle during operation of the turbine.

A first aspect of the invention includes a seal assembly for a turbine having a rotor blade and a stator nozzle. The seal assembly includes: a pair of oppositely facing seal teeth including concave surfaces, the pair of oppositely facing seal teeth positioned on one of the rotor blade and the stator nozzle for sealingly engaging the other of the rotor blade and the stator nozzle during operation of the turbine.

A second aspect of the invention includes a seal assembly for a turbine having a rotor blade and a stator nozzle. The seal assembly includes: a first pair of oppositely facing seal teeth positioned on the rotor blade; and a second pair of oppositely facing seal teeth positioned on the stator nozzle, the first pair of oppositely facing seal teeth and the second pair of oppositely facing seal teeth to sealingly engage the rotor blade and the stator nozzle during operation of the turbine.

A third aspect of the invention includes a turbine system having: a rotor blade coupled to a rotor of the turbine system; a stator nozzle coupled to a housing of the turbine system, the stator nozzle positioned adjacent the rotor blade; and a seal assembly positioned on one of the rotor blade and the stator nozzle for sealingly engaging the other of the rotor blade and the stator nozzle during operation of the turbine, the seal assembly including a pair of oppositely facing seal teeth having concave surfaces.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
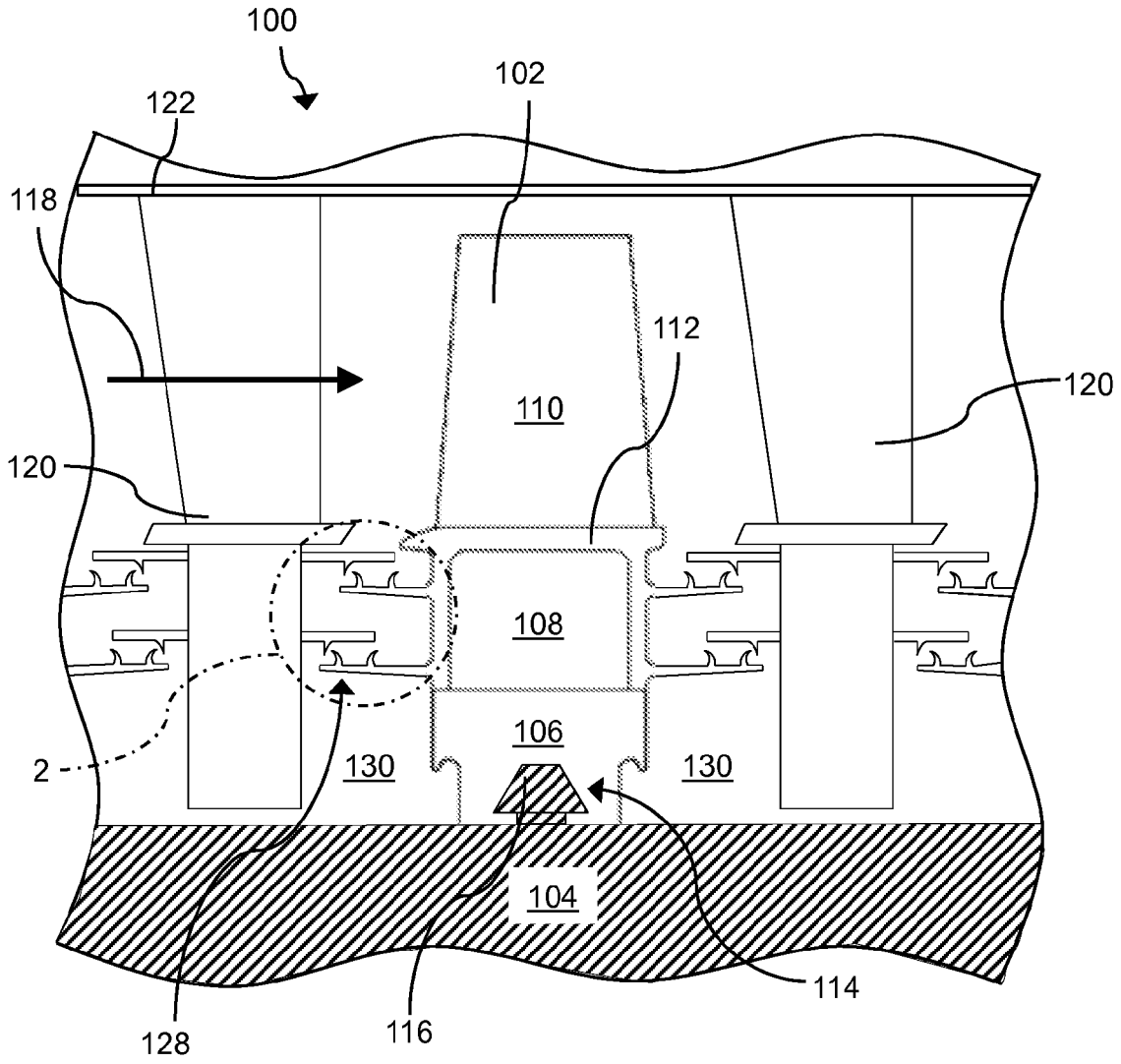
FIG. 1 shows a cross-sectional view of a portion of a turbine including a rotor blade and stator nozzles, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As described herein, aspects of the invention relate to a turbine system. Specifically, as described herein, aspects of the invention relate to a seal assembly for a turbine system.

Turning to FIG. 1, a cross-sectional view of a portion of a turbine is shown according to an embodiment of the invention. Turbine 100, as shown in FIG. 1, may be any conventional turbine (e.g., gas turbine, steam turbine) utilized by a power system for generating power. As such, a brief description of turbine 100 and the basic functionality of turbine 100 are provided for clarity. In an embodiment, as shown in FIG. 1, turbine 100 includes a rotor blade 102 coupled to rotor 104 of turbine 100. As shown in FIG. 1, rotor blade 102 may include a base section 106 coupled to rotor 104, a shank section 108 positioned outwardly of base section 106, and a blade section 110 including a platform 112 coupled to shank section 108 of rotor blade 102. Base section 106 of rotor blade 102 may include a dovetail portion 114 for engaging a complementary slot positioned on a rotor wheel 116 of rotor 104 in order to couple rotor blade 102 to rotor 104. Although only one rotor blade 102 is shown, it is understood that turbine 100 may include a plurality of rotor blades 102 coupled to rotor 104 for moving a fluid (e.g., steam, hot gas, compressed air, etc.) along an axial fluid flow path 118 of turbine 100, as described herein. The plurality of rotor blades 102 may be configured in various stages for moving fluid through turbine 100 for generating power.

Also shown in FIG. 1, turbine 100 may include a stator nozzle 120 coupled to a housing 122 of turbine 100. More specifically, as shown in FIG. 1, and as similarly discussed with respect to rotor blade 102, turbine 100 may include a plurality of stator nozzles 120. Stator nozzles 120 may be positioned adjacent rotor blade 102, and more specifically, stator nozzles 120 may be positioned on an upstream side of rotor blade 102, and a downstream side of rotor blade 102. In conjunction with rotor blade 102, stator nozzles 120 may aid in power generation by moving a fluid along axial fluid flow path 118. More specifically, fluid may flow through turbine 100 along axial fluid flow path 118, and stator nozzles 120 may be configured to direct the fluid toward blade section 110 of rotor blade 102, such that rotor blade 102 may rotate as a result of the fluid flowing over blade section 110.

Figure 2:
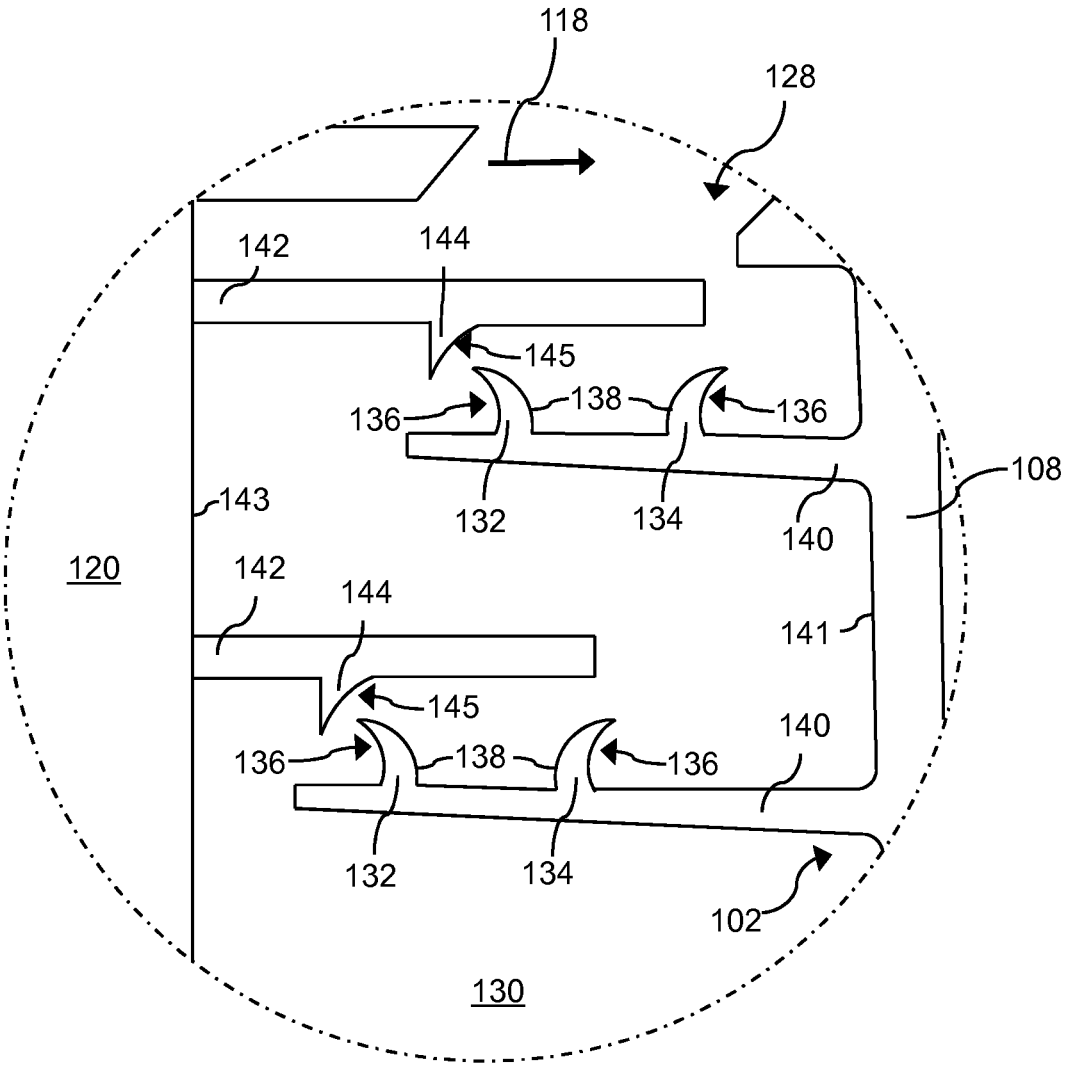
FIG. 2 shows an enlarged cross-sectional view of a seal assembly of the turbine in FIG. 1 including a pair of oppositely facing seal teeth, according to embodiments of the invention.
Figure 3:
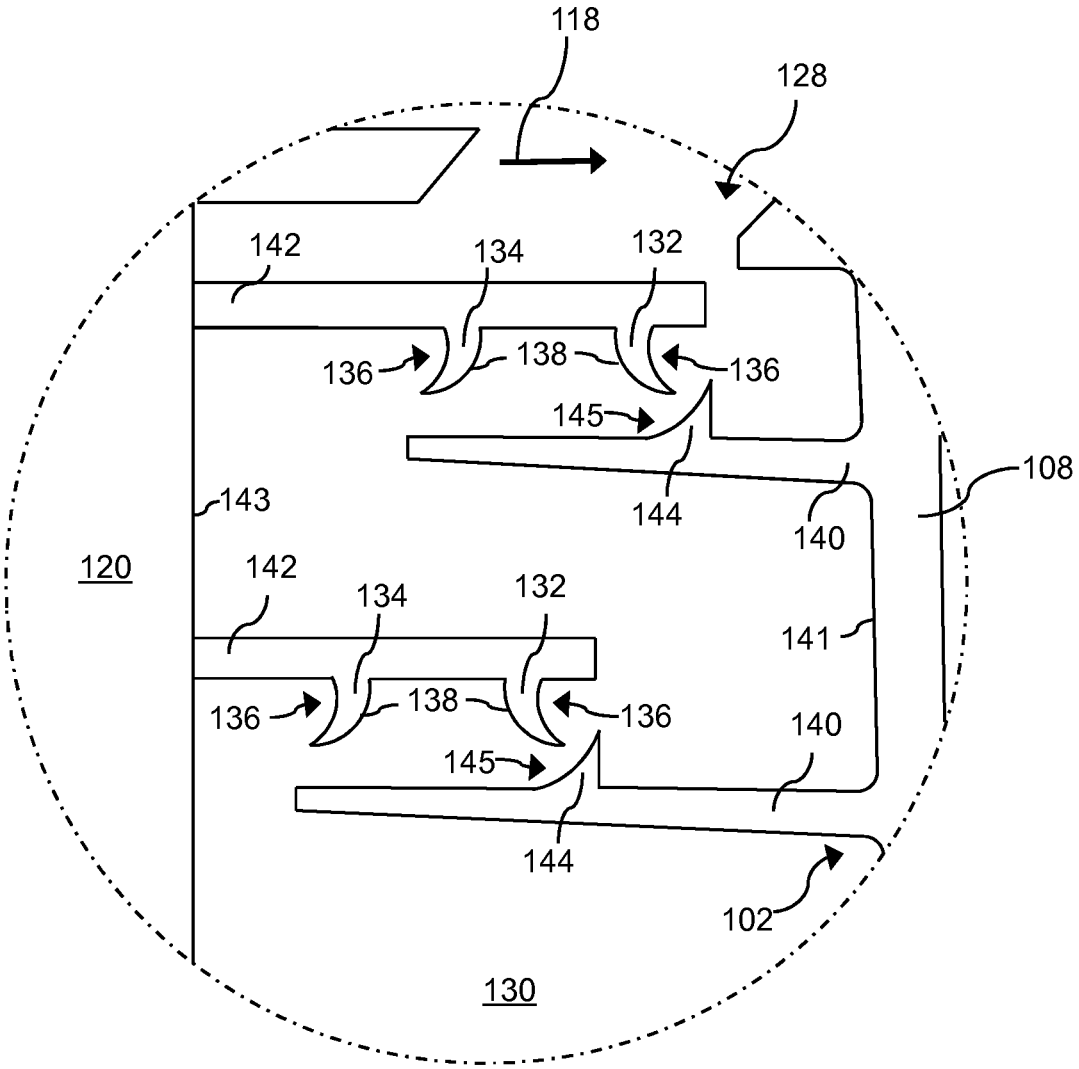
FIG. 3-6 show an enlarged cross-sectional views of a seal assembly of a turbine including a pair of oppositely facing seal teeth, according to various alternative embodiments of the invention.

In an embodiment, as shown in FIGS. 1 and 2, turbine 100 may also include a seal assembly 128 positioned within a wheel space 130 of turbine 100. Seal assembly 128 may substantially prevent fluid leakage within turbine 100, as discussed herein. More specifically, as shown in FIG. 2, seal assembly 128 for turbine 100 may include a pair of oppositely facing seal teeth 132, 134 including concave surfaces 136. In an embodiment, as shown in FIGS. 2 and 3, the pair of oppositely facing seal teeth 132, 134 may be positioned on rotor blade 102 (FIG. 2) or stator nozzle 120 (FIG. 3) for sealingly engaging the other of rotor blade 102 and stator nozzle 120 during operation of turbine 100. Concave surface 136 of each of the pair of oppositely facing seal teeth 132, 134 may face in opposite directions of one another. More specifically, as shown in FIGS. 1 and 2, concave surface 136 of an outer seal tooth 132 may face upstream relative to axial fluid flow path 118, and inner seal tooth 134 may face downstream relative to axial fluid flow path 118. In an embodiment, as shown in FIG. 2, the pair of oppositely facing seal teeth 132, 134 may also include a substantially convex surface 138 opposite concave surface 136. That is, the back surface of the pair of oppositely facing seal teeth 132, 134 may include substantially convex surfaces 138 facing one another. However, convex surface 138 may not be necessary in all cases, e.g., the surface opposite concave surface 136 could be substantially straight or angled.

In an embodiment, as shown in FIG. 2, the pair of oppositely facing seal teeth 132, 134 may be positioned on an angel wing seal 140 positioned on a side wall 141 of shank section 108 of rotor blade 102. Angel wing seal 140 may be positioned within wheel space 130 of turbine 100 and may extend axially from shank section 108 of rotor blade 102. Angel wing seal 140, and the pair of oppositely facing seal teeth 132, 134 positioned on angel wing seal 140, may be cast as a single component with rotor blade 102. In an alternative embodiment, angel wing seal 140 and/or the pair of oppositely facing seal teeth 132, 134 positioned on angel wing seal 140 may be cast as separate components and may be coupled to rotor blade 102 by any conventional mechanical coupling technique, e.g., fastening, bolting, welding, etc. In an alternative embodiment, as shown in FIG. 3 and discussed herein, the pair of oppositely facing seal teeth 132, 134 may be positioned on a sealing flange 142 positioned on a side wall 143 of stator nozzle 120.

Figure 4:
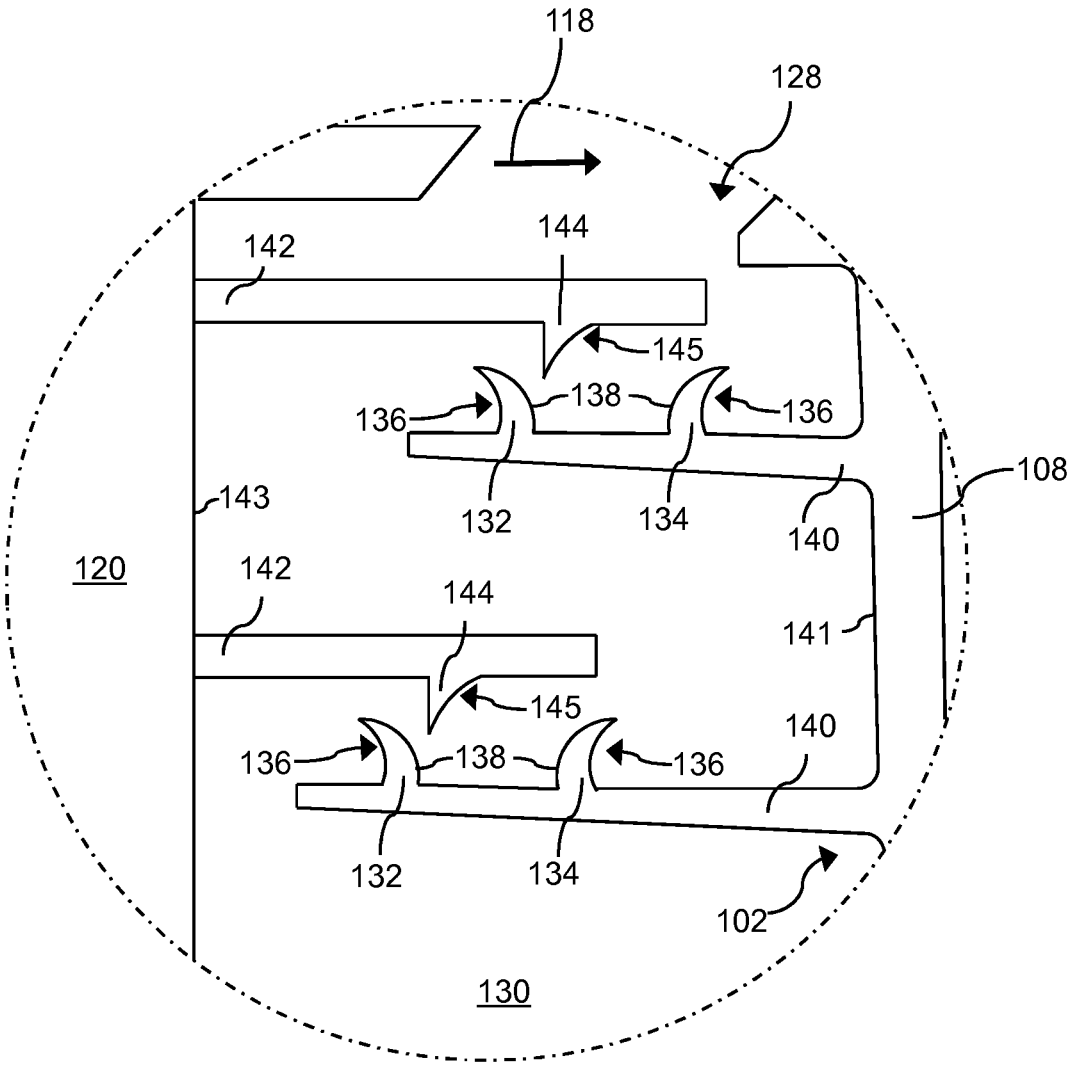

Also shown in FIGS. 2 and 3, seal assembly 128 may also include at least one fin 144 positioned on the other of rotor blade 102 and stator nozzle 120. More specifically, where the pair of oppositely facing seal teeth 132, 134 may be positioned on angel wing seal 140 of rotor blade 102, as shown in FIG. 2, the at least one fin 144 may be positioned on sealing flange 142 of stator nozzle 120. Sealing flange 142 of stator nozzle 120 may also be positioned within wheel space 130 of turbine 100, and may extend axially from side wall 143 of stator nozzle 120. As shown in FIG. 2, sealing flange 142 of stator nozzle 120 may be positioned substantially parallel to angel wing seal 140 of rotor blade 102, such that the at least one fin 144 may aid in sealingly engaging rotor blade 102 and stator nozzle 120. In an alternative embodiment, where the pair of oppositely facing seal teeth 132, 134 are positioned on sealing flange 142 of stator nozzle 120, as shown in FIG. 3, the at least one fin 144 may be positioned on angel wing seal 140 of rotor blade 102. As shown in FIGS. 2-4, the at least one fin 144 may include a substantially curved surface 145 for preventing leakage of the fluid within turbine 100, as discussed herein. Sealing flange 142, and the at least one fin 144 positioned on sealing flange 142, may be cast as a single component with stator nozzle 120. In an alternative embodiment, sealing flange 142, and the at least one fin 144 positioned on sealing flange 142, may be cast as separate components and may be coupled to sealing flange 142 by any conventional mechanical coupling technique, e.g., fastening, bolting, welding, etc.

In various embodiments, as shown in FIGS. 2-4, the at least one fin 144 may be positioned substantially adjacent one of the pair of oppositely facing seal teeth 132, 134. As shown in FIGS. 2 and 3, the at least one fin 144 may be positioned adjacent concave surface 136 of one of the pair of oppositely facing seal teeth 132, 134. More specifically, in an embodiment as shown in FIG. 2, the at least one fin 144 may be positioned substantially adjacent concave surface 136 of outer seal tooth 132 of the pair of oppositely facing seal teeth 132, 134 positioned on angel seal wing 140 of rotor blade 102. In an alternative embodiment, as shown in FIG. 3, the at least one fin 144 may be positioned substantially adjacent concave surface 136 of inner seal tooth 134 of the pair of oppositely facing seal teeth 132, 134 positioned on sealing flange 142 of stator nozzle 120. In a further alternative embodiment, as shown in FIG. 4, the at least one fin 144 may be positioned substantially adjacent one of the pair of oppositely facing seal teeth 132, 134, and more specifically, may be positioned substantially between the pair of oppositely facing seal teeth 132, 134. As shown in FIG. 4, the at least one fin 144 may be positioned adjacent convex surface 138 of outer seal tooth 132, and may also be positioned between outer seal tooth 132 and inner seal tooth 134 of the pair of oppositely facing seal teeth 132, 134.

Turning back to FIG. 1, seal assembly 128 may be positioned on an upstream side and/or a downstream side of rotor blade 102 and/or stator nozzle 120. More specifically, as shown in FIG. 1, the pair of oppositely facing seal teeth 132, 134 may be positioned on an upstream side of rotor blade 102 and/or stator nozzle 120, and may be positioned on a downstream side of rotor blade 102 and/or stator nozzle 120. In an embodiment, as shown in FIG. 1, where the pair of oppositely facing seal teeth 132, 134 are positioned on an upstream side of rotor blade 102, the at least one fin 144 positioned on sealing flange 142 may be positioned on a downstream side of stator nozzle 120. As shown in FIG. 1, where the pair of oppositely facing seal teeth 132, 134 are positioned on a downstream side of rotor blade 102, the at least one fin 144 positioned on sealing flange 142 may be positioned on an upstream side of stator nozzle 120. In an alternative embodiment, where the pair of oppositely facing seal teeth 132, 134 are positioned on sealing flange 142 (e.g., FIG. 3) of stator nozzle 120 on a downstream side, the at least one fin 144 positioned on angel seal wing 140 may be positioned on an upstream side of rotor blade 102. Additionally, where the pair of oppositely facing seal teeth 132, 134 are positioned on sealing flange 142 (e.g., FIG. 3) of stator nozzle 120 on an upstream side, the at least one fin 144 positioned on angel seal wing 140 may be positioned on a downstream side of rotor blade 102. Although FIG. 1 shows sealing assembly 128 positioned on both an upstream side and a downstream side of rotor blade 102 and stator nozzle 120, it is understood that sealing assembly 128 may be positioned only on a single side (e.g., upstream side, downstream side) of each respective component (e.g., rotor blade 102, stator nozzle 120) of turbine 100. That is, in an example, not shown, sealing assembly may only be positioned on a downstream side of stator nozzle 120 and an adjacent a upstream side of rotor blade 102, respectively.

Figure 5:
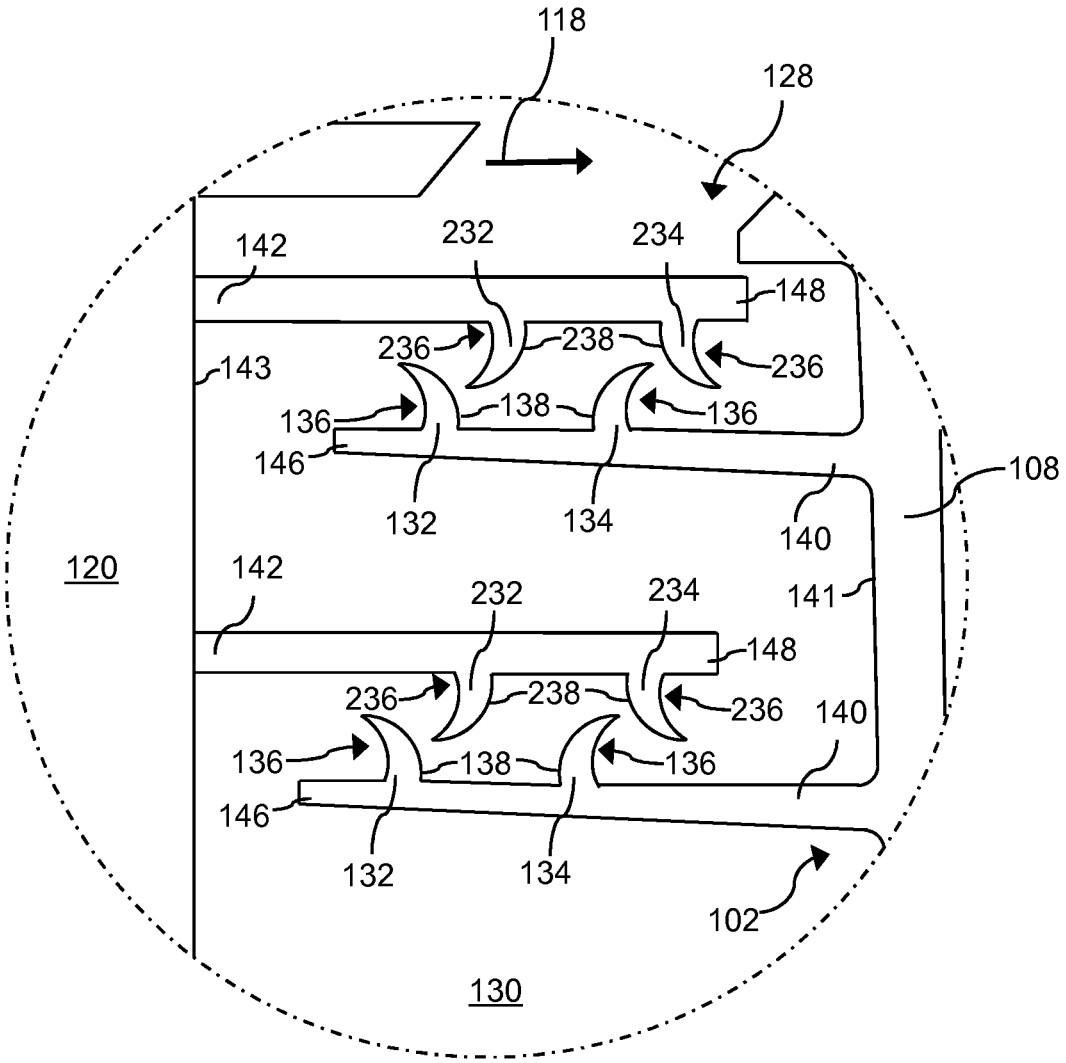
Figure 6:
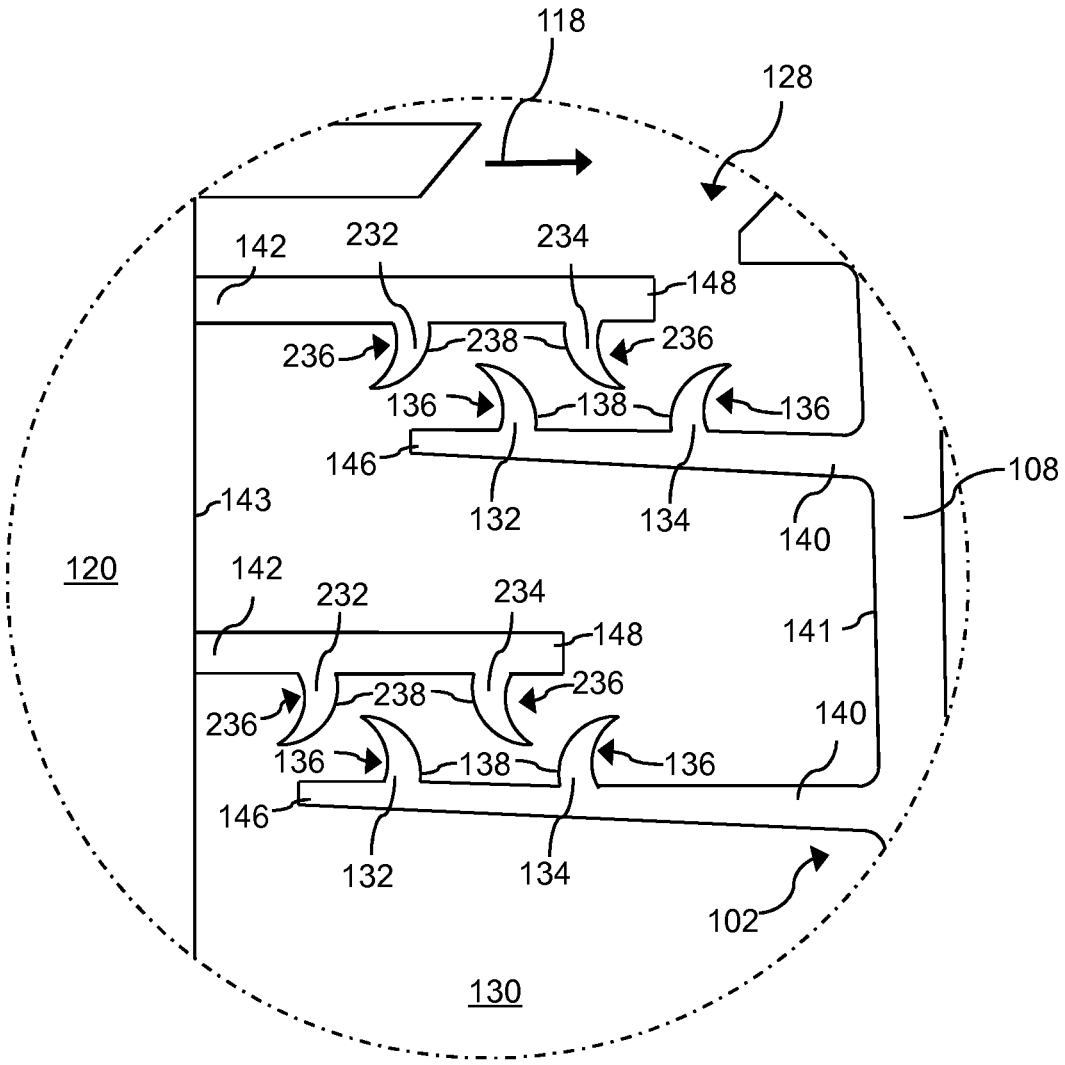

In alternative embodiments, as shown in FIGS. 5 and 6, seal assembly 128 for turbine 100 may include a first pair of oppositely facing seal teeth 132, 134 positioned on rotor blade 102, and a second pair of oppositely facing seal teeth 232, 234 positioned on stator nozzle 120. First pair of oppositely facing seal teeth 132, 134 and second pair of oppositely facing seal teeth 232, 234 may be for sealingly engaging rotor blade 102 and stator nozzle 120 during operation of turbine 100. That is, the use of two pair of oppositely facing seal teeth (e.g., 132, 134, 232, 234) may aid in fluid leakage between axial fluid flow path 118 and wheel space 130 of turbine 100. As described herein with respect to FIGS. 2-4, each of the first pair of oppositely facing seal teeth 132, 134 may include concave surface 136 facing in opposite directions of one another, and each of the second pair of oppositely facing seal teeth 232, 234 may include concave surface 236 facing in opposite directions of one another. Additionally, as shown in FIGS. 5 and 6, each of the first pair of oppositely facing seal teeth 132, 134 may include a substantially convex surface 138 opposite concave surfaces 136, and the second pair of oppositely facing seal teeth 232, 234 may include a substantially convex surface 238 opposite concave surfaces 236.

In various embodiments, as shown in FIGS. 5 and 6, the first pair of oppositely facing seal teeth 132, 134 may include an outer tooth 132 positioned adjacent an end 146 of angel wing seal 140, and an inner tooth 134 positioned on angel wing seal 140 between outer tooth 132 and shank section 108 of rotor blade 102. Also shown in FIGS. 5 and 6, the second pair of oppositely facing seal teeth 232, 234 may include an outer tooth 232 positioned adjacent an end 148 of sealing flange 142, and an inner tooth 234 positioned on sealing flange 142 between outer tooth 232 and stator nozzle 120. In an embodiment, as shown in FIG. 5, inner tooth 134 of the first pair of oppositely facing seal teeth 132, 134 may be positioned substantially between outer tooth 232 and inner tooth 234 of the second pair of oppositely facing seal teeth 232, 234. Alternatively, as shown in FIG. 6, outer tooth 132 of the first pair of oppositely facing seal teeth 132, 134 may be positioned substantially between outer tooth 232 and inner tooth 234 of the second pair of oppositely facing seal teeth 232, 234.

As discussed herein with reference to FIG. 1, the first pair of oppositely facing seal teeth 132, 134 and the second pair of oppositely facing seal teeth 232, 234 may be positioned on an upstream side and/or downstream side of rotor blade 102 and/or stator nozzle 120. More specifically, as shown in FIGS. 5 and 6, the first pair of oppositely facing seal teeth 132, 134 may be positioned on an upstream side of rotor blade 102, and the second pair of oppositely facing seal teeth 232, 234 may be positioned on a downstream side of stator nozzle 120. In an alternative embodiment, not shown, the first pair of oppositely facing seal teeth 132, 134 may be positioned on a downstream side of rotor blade 102, and the second pair of oppositely facing seal teeth 232, 234 may be positioned on an upstream side of stator nozzle 120.

Figure 7:
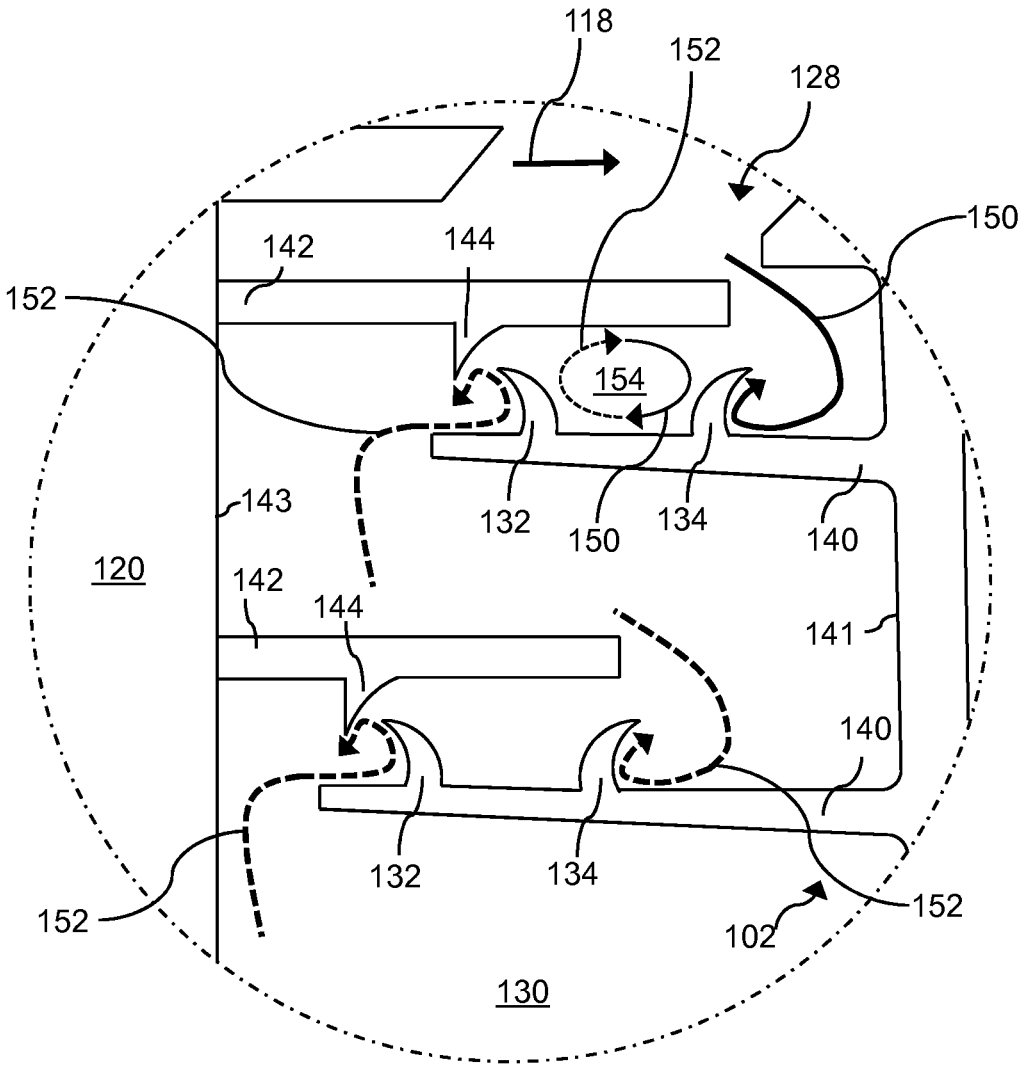
FIG. 7 shows an enlarged cross-sectional view of a seal assembly of the turbine in FIG. 1 including an axial fluid flow path and a purge fluid flow path, according to embodiments of the invention.

Turning to FIG. 7, an enlarged cross-sectional view of seal assembly 128 of turbine 100 in FIG. 1 including flow paths is shown, according to embodiments of the invention. That is, FIG. 7 shows seal assembly 128 shown in FIGS. 1 and 2, and includes a fluid flow path for a portion of escaped fluid 150 of axial fluid flow path 118 and a purge fluid flow path 152 (shown in phantom), as it flows within wheel space 130 and around seal assembly 128. As shown in FIG. 7, purge fluid 152 may include any conventional cooling fluid (e.g., cold air, saturated air, etc.) for cooling wheel space 130 during operation of turbine 100. For turbine 100 to operate at a heightened efficiency, the fluid flowing in axial fluid flow path 118 may be maintained in axial fluid flow path 118, and may flow over the blade section 110 in order to drive rotor blade 102 of turbine 100. That is, the portion of escaped fluid 150 may be prevented from entering wheel space 130 of turbine 100 by seal assembly 128. By preventing the escaped fluid 150 from entering wheel space 130, a loss of fluid flow over blade section 110 of rotor blade 102 may be prevented and/or the undesirable heating of wheel space 130 during operation of turbine 100 may also be prevented. In parallel, for turbine 100 to operate at a heightened efficiency, the purge fluid 152 may be maintained in a purge fluid flow path, and may flow within wheel space 130 in order to cool wheel space 130 during operation of turbine 100. That is, purge fluid 152 flowing in the purge fluid flow path may be prevented from mixing with the fluid of axial fluid flow path 118 of turbine 100 by seal assembly 128. The prevention of mixing purge fluid 152 with the fluid of axial fluid flow path 118 may result in preventing the loss in pressure and/or temperature of fluid flow over blade section 110 of rotor blade 102 during the operation of turbine 100.

During operation of turbine 100, a portion of the escaped fluid 150 of axial fluid flow path 118 may move toward seal assembly 128 positioned within wheel space 130. As shown in FIG. 7, seal assembly 128 may substantially prevent escaped fluid 150 from entering wheel space 130. More specifically, as shown in FIG. 7, inner tooth 134 of the pair of oppositely facing seal teeth 132, 134 of seal assembly 128 may redirect the majority of the portion of escaped fluid 150 away from wheel space 130 and back to axial fluid flow path 118 using concave surface 136. Similarly, as shown in FIG. 7, purge air 152 may be redirected away from axial fluid flow path 118, and back into wheel space 130 by concave surface 136 of outer tooth 136 of seal assembly 128. The at least one fin 144 may also aid in the redirection of the escaped portion of fluid 150 and/or purge fluid 152, dependent on a positioning of the at least one fin 144 within seal assembly 128. In an embodiment, as shown in FIG. 7, the at least one fin 144 may be positioned adjacent outer tooth 132 of the pair of oppositely facing seal teeth 132, 134 of seal assembly 128. As a result, as shown in FIG. 7, concave surface 136 of outer tooth 132 may redirect purge fluid 152 away from axial fluid flow path 118, and substantially curved surface 145 of the at least one fin 144 may also direct purge fluid 152 inward toward wheel space 130. By redirecting purge fluid 152 inward into wheel space 130, the at least one fin 144 may provide further aid in preventing purge fluid 152 from entering axial fluid flow path 118 of turbine 100.

As shown in FIG. 7, a small portion of escaped fluid 150 and purge fluid 152 may move past the respective teeth (e.g., outer tooth 132, inner tooth 134) of the pair of oppositely facing seal teeth 132, 134. The small portion of escaped fluid 150 and purge fluid 152 may mix together in a cavity 154 positioned between the pair of oppositely facing seal teeth 132, 134, and may be substantially maintained within cavity 154 during operation of turbine 100. More specifically, because of the flow path of the small portion of escaped fluid 150 and purge fluid 152 flowing into cavity 154 and the flow path in which the small portion of escaped fluid 150 and purge fluid 152 may flow over convex surface 138 of the pair of oppositely facing seal teeth 132, 134, the small portion of escaped fluid 150 and purge fluid 152 may be substantially maintained within cavity 154 during the operation of turbine 100. As a result, escaped fluid 150 and purge fluid 152 that may flow into cavity 154 may also be substantially prevented from entering an undesirable space (e.g., wheel space 130) and/or flow path (e.g., axial fluid flow path 118) during operation of turbine 100.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A seal assembly for a turbine having a rotor blade and a stator nozzle, the seal assembly comprising:

a pair of seal teeth including oppositely facing concave surfaces, the pair of seal teeth positioned on one of the rotor blade or the stator nozzle for sealingly engaging the other of the rotor blade or the stator nozzle during operation of the turbine.

2. The seal assembly of claim 1, wherein each of the pair of seal teeth includes a substantially convex surface opposite the concave surface.

3. The sealing assembly of claim 1, further comprising at least one fin positioned on the other of the rotor blade or the stator nozzle.

4. The sealing assembly of claim 3, wherein the at least one fin is positioned substantially adjacent one of the pair of seal teeth.

5. The sealing assembly of claim 3, wherein the at least one fin is positioned substantially between the pair of seal teeth.

6. The sealing assembly of claim 1, wherein the pair of seal teeth are positioned on an upstream side of the one of the rotor blade or the stator nozzle, the upstream side being upstream of an axial fluid flow path through the turbine.

7. The sealing assembly of claim 6, wherein the pair of seal teeth are positioned on a downstream side of the one of the rotor blade or the stator nozzle, the downstream side being downstream of the axial fluid flow path through the turbine.

8. A seal assembly for a turbine having a rotor blade and a stator nozzle, the seal assembly comprising:

a first pair of seal teeth positioned on the rotor blade; and a second pair of seal teeth positioned on the stator nozzle, the first pair of seal teeth and the second pair of seal teeth configured to sealingly engage the rotor blade and the stator nozzle during operation of the turbine;

wherein each of the first pair of seal teeth includes a concave surface, the concave surfaces facing in an opposite direction with respect to one another, and wherein each of the second pair of seal teeth includes a concave surface, the concave surfaces facing in an opposite direction with respect to one another.

9. The seal assembly of claim 8, wherein each of the first pair of seal teeth includes a substantially convex surface opposite the concave surface, and wherein each of the second pair of seal teeth includes a substantially convex surface opposite the concave surface.

10. The seal assembly of claim 8, wherein the first pair of seal teeth includes an outer tooth, and an inner tooth, and wherein the second pair of seal teeth includes an outer tooth, and an inner tooth.

11. The seal assembly of claim 10, wherein the inner tooth of the first pair of seal teeth is positioned substantially between the outer tooth and the inner tooth of the second pair of seal teeth.

12. The seal assembly of claim 10, wherein the outer tooth of the first pair of seal teeth is positioned substantially between the outer tooth and the inner tooth of the second pair of seal teeth.

13. The seal assembly of claim 8, wherein the first pair of seal teeth are positioned on an upstream side of the rotor blade, the upstream side being upstream of an axial fluid flow path through the turbine.

14. The seal assembly of claim 13, wherein the second pair of seal teeth are positioned on a downstream side of the stator nozzle, the downstream side being downstream of the axial fluid flow path through the turbine.

15. The seal assembly of claim 8, wherein the first pair of seal teeth are positioned on a downstream side of the rotor blade, the downstream side relative to an axial fluid flow path through the turbine.

16. The seal assembly of claim 15, wherein the second pair of seal teeth are positioned on an upstream side of the stator nozzle, the upstream side relative to the axial fluid flow path through the turbine.

17. A turbine comprising:

a rotor blade coupled to a rotor of the turbine;

a stator nozzle coupled to a housing of the turbine, the stator nozzle positioned adjacent the rotor blade; and a seal assembly positioned on one of the rotor blade or the stator nozzle for sealingly engaging the other of the rotor blade or the stator nozzle during operation of the turbine, the seal assembly including a pair of seal teeth having oppositely facing concave surfaces.

* * * * *